United States Patent [19]

Siga et al.

[11] Patent Number: 4,850,187

[45] Date of Patent: Jul. 25, 1989

[54] GAS TURBINE HAVING COMPONENTS COMPOSED OF HEAT RESISTANT STEEL

[75] Inventors: Masao Siga; Yutaka Fukui, both of Hitachi; Mitsuo Kuriyama, Ibaraki; Soichi Kurosawa, Hitachi; Katsumi Iijima, Hitachi; Nobuyuki Iizuka, Hitachi; Yosimi Maeno, Hitachi; Shintaro Takahashi, Hitachi; Yasuo Watanabe, Katsuta; Ryo Hiraga, Hitachiota, all of Japan

[73] Assignee: Hitachi, Ltd., Tokyo, Japan

[21] Appl. No.: 10,793

[22] Filed: Feb. 4, 1987

[30] Foreign Application Priority Data

Feb. 5, 1986 [JP] Japan ..... 61-21956
Mar. 20, 1986 [JP] Japan ..... 61-60574

[51] Int. Cl.[4] ..... F02C 3/04

[52] U.S. Cl. ..... 60/39.37; 60/909; 416/241 R; 148/325; 148/327; 148/442; 148/427; 148/425; 148/334

[58] Field of Search ..... 416/241 R, 212 A; 60/39.37, 909; 420/69, 109, 111, 34, 453, 43, 436, 439; 148/325, 427, 335, 442, 334, 327, 425; 415/244 A

[56] References Cited

U.S. PATENT DOCUMENTS 4,127,410 11/1978 Merrick et al. ..... 420/450
4,497,670 2/1985 Siga et al. ..... 148/325
4,553,386 11/1985 Berg ..... 60/39.37

FOREIGN PATENT DOCUMENTS 2320185 10/1974 Fed. Rep. of Germany ..... 420/109
3522115 1/1986 Fed. Rep. of Germany ..... 420/69
55-82755 6/1980 Japan ..... 148/33 S
58-217661 12/1983 Japan ..... 420/69

*Primary Examiner*—Deborah Yee
*Attorney, Agent, or Firm*—Antonelli, Terry & Wands

[57] ABSTRACT

A heat resistant steel of the present invention contains 0.05 to 0.2 wt. % of C, less than 0.5 wt. % of Si, less than 0.6 wt. % of Mn, 8 to 13 wt. % of Cr, 1.5 to 3 wt. % of Mo, 2 to 3 wt. % of Ni, 0.05 to 0.3 wt. % of V, 0.02 to 0.2 wt. % in total of either or both of Nb and Ta, 0.02 to 0.1 wt. % of N and the balance substantially Fe. Since a gas turbine of the present invention is constituted by members, such as discs, blades, shafts and so forth, made of alloys of this kind, the gas turbine has a structure in which it is possible to achieve a high level of creep rupture strength and Charpy impact value.

28 Claims, 5 Drawing Sheets

GAS TURBINE HAVING COMPONENTS COMPOSED OF HEAT RESISTANT STEEL

BACKGROUND OF THE INVENTION

1. Field of the Invention

The present invention relates generally to a novel heat resistant steel, and more particularly to a novel gas turbine in which the heat resistant steel is used.

2. Description of the Prior Art

Cr-Mo-V steel is currently used in the discs for a gas turbine.

There has recently been a demand for improvement in the thermal efficiency of gas turbines from the viewpoint of the saving of energy. The most useful means of improving the thermal efficiency of a gas turbine is to increase the temperature and pressure of the gas used, and an improvement in the efficiency of about 3% in terms of relative ratio may be expected by raising the temperature of the gas used from 1,100° C. to 1,300° C. and increasing the pressure ratio from 10 to 15.

However, since the conventional Cr-Mo-V steel becomes insufficient in its strength in accompaniment with such high temperature and pressure ratio, a steel material having a higher strength is needed. Creep rupture strength has the biggest influence on the high-temperature properties and hence is a critical requirement with respect to the strength. Austenitic steel, Ni-based alloy, Co-based alloy and martensitic steel are generally known as structural material having level of creep rupture strength which is higher than that of Cr-Mo-V steel. However, Ni-based alloy and Co-based alloy are undesirable from the standpoint of hot workability, machinability, vibration damping property, etc. Austenitic steel is also undesirable since its high-temperature strength is not so high in the vicinity of temperatures between 400° and 450° C., as well as from the viewpoint of the entire gas turbine system. On the other hand, martensitic steel well matches other constituent parts and also has a sufficient high-temperature strength. Typical martensitic steels have been disclosed in Japanese Patent Unexamined Publication No. 110661/83 and No. 138054/85, and Japanese Patent Examined Publication No. 2739/71. However, these materials are not necessarily able to achieve a high creep rupture strength at temperatures between 400° and 450° C., and further since the toughness of these materials after having been heated at high temperatures for long period of time is low, they cannot be used for turbine discs, so that an improvement in the efficiency of gas turbines cannot be achieved.

As is evident from the foregoing, if one uses a material merely having a high strength to cope with the high temperature and the high pressure involved with gas turbines, it is impossible to raise the temperature of the gas. In general, as the strength is increased, the toughness is decreased.

SUMMARY OF THE INVENTION

It is therefore an object of the present invention to provide a heat resistant steel having not only a high-temperature strength but also a high toughness after having been heated at high temperatures for long period of time.

It is another object of the present invention to provide a gas turbine having a high thermal efficiency.

To these ends, according to a first aspect of the present invention, there is provided a heat resistant steel containing 0.05 to 0.2 wt. % of C, less than 0.5 wt. % of Si, less than 0.6 wt. % of Mn, 8 to 13 wt. % of Cr, 1.5 to 3 wt. % of Mo, 2 to 3 wt. % of Ni, 0.05 to 0.3 wt. % of V, 0.02 to 0.2 wt. % in total of either or both of Nb and Ta, 0.02 to 0.1 wt. % of N, a ratio (Mn/Ni) of the aforementioned Mn to Ni being less than 0.11, and the balance substantially Fe.

According to a second aspect of the present invention, there is provided a heat resistant steel containing 0.07 to 0.15 wt. % of C, 0.01 to 0.1 wt. % of Si, 0.1 to 0.4 wt. % of Mn, 11 to 12.5 wt. % of Cr, 2.2 to 3.0 wt. % of Ni, 1.8 to 2.5 wt. % of Mo, 0.04 to 0.08 wt. % in total of either or both of Nb and Ta, 0.15 to 0.25 wt. % of V, 0.04 to 0.08 wt. % of N, a ratio (Mn/Ni) of the aforementioned Mn to Ni being 0.04 to 0.10, and the balance substantially Fe, and having a wholly tempered martensite structure.

Further, the steel of the present invention may also contain at least one seleced from the group consisting of less than 1 wt. % of W, less than 0.5 wt. % of Co, less than 0.5 wt. % of Cu, less than 0.01 wt. % of B, less than 0.5 wt. % of Ti, less than 0.3 wt. % of Al, less than 0.1 wt. % of Zr, less than 0.1 wt. % of Hf, less than 0.01 wt. % of Ca, less than 0.01 wt. % of Mg, less than 0.01 wt. % of Y and less than 0.01 wt. % of rare earth elements.

The composition of the steel of the present invention is so adjusted that the Cr equivalent calculated from the following equation becomes less than 10, and it is also necessary to ensure that the steel contains materially no δ-ferrite phase.

$$\text{Cr equivalent} = -40C - 2Mn - 4Ni - 30N + 6Si + Cr + 4Mo + 11V + 5Nb + 2.5Ta$$

(where the above equation is calculated using the contents in weight percent of the respective elements in the alloy.)

According to a third aspect of the present invention, there is provided a disc having in its outer circumferential portion a plurality of recessed grooves into which blades are embedded, having a maximum thickness in its center and having in its outer circumferential side a plurality of through-holes into which bolts are inserted to connect a plurality of the discs, and characterized by being made of a martensitic steel having a 450° C., $10^5$-h creep rupture strength of higher than 50 kg/mm$^2$ and a 25° C. V-notch Charpy impact value of higher than 5 kg-m/cm$^2$ after having been heated at 500° C. for $10^3$ hours, and having a wholly tempered martensite structure, or by being made of a heat resistant steel having the aforementioned composition.

A plurality of turbine discs are connected together at their outer circumferential sides by the bolts with annular spacers interposed therebetween, these spacers being characterized by being made of a martensitic steel having the aforementioned properties or of a heat resistant steel having the aforementioned composition.

According to a fourth aspect of the present invention, there are provided the following members (a), (b) and (c), each of which is characterized by being made of a martensitic steel having the aforementioned composition:

(a) a cylindrical distance piece through which the turbine discs and the compressor discs are connected together by bolts;

(b) at least one of a set of bolts for connecting a plurality of turbine discs and another set of bolts for connecting a plurality of compressor discs; and (c) a compressor disc having in its outer circumferential portion a plurality of recessed grooves into which blades are embedded, having in its outer circumferential side a plurality of through-holes into which bolts are inserted to connect a plurality of the discs and having in its center and portions provided with the through-holes a maximum thickness.

According to a fifth aspect of the present invention, there is provided a gas turbine comprising a turbine stub shaft, a plurality of turbine discs connected to the shaft by turbine stacking bolts with spacers interposed between the turbine discs, turbine blades embedded into each of the turbine discs, a distance piece connected to the turbine discs by the turbine stacking bolts, a plurality of compressor discs connected to the distance piece by compressor stacking bolts, compressor blades embedded into each of the compressor discs and a compressor stub shaft integral with a first stage disc of the compressor discs, characterized in that at least the turbine disc is made of a martensitic steel having a 450° C. $10^5$-h creep rupture strength of higher than 50 kg/mm$^2$ and a 25° C. V-notch Charpy impact value of higher than 5 kg-m/cm$^2$ after having been heated at 500° C. for $10^3$ hours, and having a wholly tempered martensite structure. The martensitic steel is particularly composed of a heat resistant steel having the aforementioned composition.

When the above-mentioned martensitic steel is used for the gas turbine disc in accordance with the present invention, a ratio (t/D) of the thickness (t) in the central portion of the disc to the diameter (D) thereof is limited to 0.15 to 0.3, thereby enabling a reduction in the weight of the disc. In particular, by limiting the ratio (t/D) to 0.18 to 0.22 it is possible to shorten the distance between the respective discs, so that improvement in the thermal efficiency can be expected.

DESCRIPTION OF THE PREFERRED EMBODIMENTS

Figure 1:
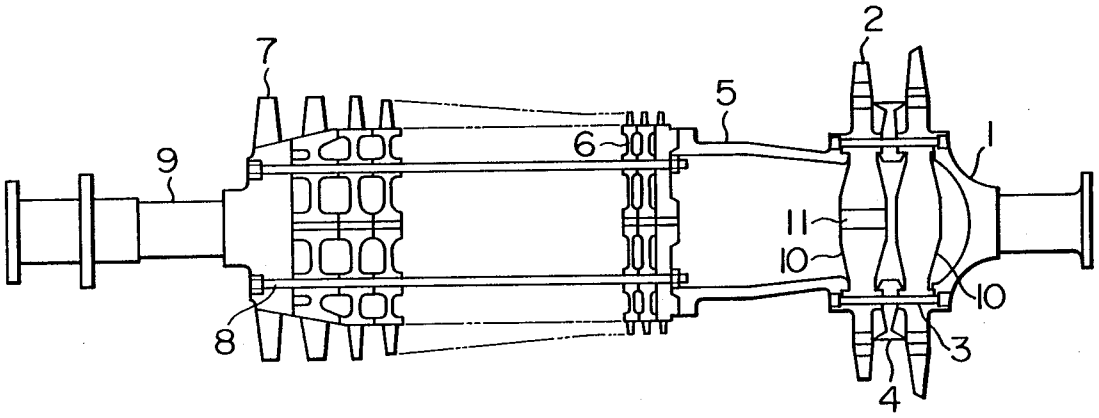
FIG. 1 is a cross-sectional view of the rotary section of a gas turbine showing an embodiment of the present invention.

Description will be made below with respect to the reason for limiting the compositional range of the material according to the present invention.

A minimum of 0.05 wt. % of C is needed in order to obtain a high tensile strength and a high proof stress. However, if an excessive amount of C is added, a metal structure becomes unstable when the steel is exposed to high temperatures for long period of time thereby decreasing a $10^5$-h creep rupture strength, so that the C content must be less than 0.20 wt. %. Preferably the C content is 0.07 to 0.15 wt. %, and more preferably 0.10 to 0.14 wt. %.

Si is added as deoxidizer and Mn as deoxidizer and desulfurizer when the steel is melted, and they are affective even with a small amount. Si is a δ-ferrite former, and since the addition of a large amount of Si causes the formation of δ-ferrite which decreases the fatigue strength and toughness, the Si content must be less than 0.5 wt. %. Incidentally, by a carbon vacuum deoxidation method, an electroslag melting method and the like, it is unnecessary to add Si, so that it is preferable to add no Si.

In particular, the Si content is preferably less than 0.2 wt. % from the viewpoint of embrittlement and, even if no Si is added, 0.01 to 0.1 wt. % of Si is contained as an impurity.

The Mn content must be less than 0.6 wt. %, since Mn promotes the embrittlement by heating. In particular, Mn is effective as a desulfurizer, and thus the Mn content is preferably 0.1 to 0.4 wt. % so as not to cause any embrittlement by heating. Moreover, most preferably it is 0.1 to 0.25 wt. %. Also, the total content of Si+Mn is preferably less than 0.3 wt. % from the viewpoint of the prevention of embrittlement.

Cr enhances a corrosion resistance and a high-temperature strength but, if more than 13 wt. % of Cr is added, it causes the formation of δ-ferrite structure. If the Cr content is less than 8 wt. % no sufficient corrosion resistance and high-temperature strength can be obtained. Therefore, the Cr content is limited to 8 to 13 wt. %. In particular, the Cr content is preferably 11 to 12.5 wt. %.

Mo enhances a creep rupture strength owing to its solid solution strengthening and precipitation strengthening actions, and it further has the effect of preventing the embrittlement. If the Mo content is less than 1.5 wt. %, no sufficient effect of enhancing the creep rupture strength is obtained. More than 30 wt. % of Mo causes the formation of δ-ferrite. Therefore, the Mo content is limited to 1.5 to 3.0 wt. %, preferably 1.8 to 2.5 wt. % in particular. Moreover, when the Ni content exceeds 2.1 wt. %, Mo has such an effect that the higher the Mo content is, the higher is the creep rupture strength, and in particular this effect is remarkable when the Mo content is higher than 2.0 wt. %.

V and Nb precipitate carbide, thereby bring about an effect of enhancing the high-temperature strength as well as improving the toughness. If the contents of V and Nb are respectively less than 0.1 wt. % and less than 0.02 wt. %, no sufficient effect can be obtained, whereas if the contents of V and Nb are respectively higher than 0.3 wt. % and higher than 0.2 wt. %, it causes the formation of δ-ferrite and exhibits a tendency to decrease the toughness. In particular, it is preferable that the V content is 0.15 to 0.25 wt. % and the Nb content is 0.04 to 0.08 wt. %. Instead of Nb, Ta may be added in exactly same content, and Nb and Ta may also be added in combination.

Ni enhances a toughness after having been heated at high temperatures for long period of time, and has an effect of preventing the formation of δ-ferrite. If the Ni content is less than 2.0 wt. %, no sufficient effect can be obtained, whereas if it is higher than 3 wt. %, a long-time creep rupture strength is decreased. In particular, it is preferable that the Ni content is 2.2 to 3.0 wt. %, more preferably it exceeds 2.5 wt. %.

Ni has an effect of preventing the embrittlement by heating, whereas conversely Mn does harm this effect. The present inventors have found that there is a close correlation between these elements. Namely, they found the fact that when a ratio (Mn/Ni) is less than 0.11, the embrittlement by heating is remarkably prevented. In particular, the ratio is preferably less than 0.10, more preferably 0.04 to 0.10.

N is effective in improving a creep rupture strength and preventing the formation of δ-ferrite, but if the N content is less than 0.02 wt. %, no sufficient effect can be obtained. If the N content exceeds 0.1 wt. %, the toughness is decreased. In particular, the superior properties can be obtained in the N content range of 0.04 wt. % to 0.08 wt. %.

In the heat resistant steel according to the present invention, Co is effective in strengthening the steel but promotes the embrittlement, so that the Co content should be less than 0.5 wt. %. Since W contributes to the strengthening similarly to Mo, it may be contained in an amount less than 1 wt. %. In addition, the high-temperature strength can be improved by adding less than 0.01 wt. % of B, less than 0.3 wt. % of Al, less than 0.5 wt. % of Ti, less than 0.1 wt. % of Zr, less than 0.1 wt. % of Hf, less than 0.01 wt. % of Ca, less than 0.01 wt. % of Mg, less than 0.01 wt. % of Y, less than 0.01 wt. % of rare earth elements and less than 0.5 wt. % of Cu.

Referring to heat treatment for the material of the present invention, the material is uniformly heated at a temperature (at the lowest: 900° C. at the highest: 1150° C.) sufficient to transform it to a complete austenite, and then quenched so as to obtain a martensite structure. The martensite structure is obtained by quenching the material at a rate higher than 100° C./h, and it is heated to and held at a temperature between 450° and 600° C. (a first tempering), and then it is subjected to a second tempering by being heated to and held at a temperature between 550° and 650° C. On hardening, it is preferable to stop the quenching at a temperature immediately above an Ms point in order to prevent the quenching crack. Concretely, it is preferable to stop the quenching at a temperature higher than 150° C. It is preferable to carry out the hardening by an oil hardening or a water spray hardening. The first tempering is started from the temperature at which the quenching is stopped.

More than one of the aforementioned distance piece, turbine spacer, turbine stacking bolt, compressor stacking bolt and at least a final stage disc of the compressor discs can be made of a heat resistant steel containing 0.05 to 0.2 wt. % of C, less than 0.5 wt. % of Si, less than 1 wt. % of Mn, 8 to 13 wt. % of Cr, less than 3 wt. % of Ni, 1.5 to 3 wt. % of Mo, 0.05 to 0.3 wt. % of V, 0.02 to 0.2 wt. % of Nb, 0.02 to 0.1 wt. % of N and the balance substantially Fe, and having a wholly tempered martensite structure. By composing all of these parts with this heat resistant steel, it is possible to further raise the temperature of gas thereby improving the thermal efficiency. High resistance to embrittlement is obtained and remarkably safe gas turbine is obtained particularly when at least one of these parts is made of a heat resistant steel containing 0.05 to 0.2 wt. % of C, less than 0.5 wt. % of Si, less than 0.6 wt. % of Mn, 8 to 13 wt. % of Cr, 2 to 3 wt. % of Ni, 1.5 to 3 wt. % of Mo, 0.05 to 0.3 wt. % of V, 0.02 to 0.2 wt. % of Nb, 0.02 to 0.1 wt. % of N, a ratio (Mn/Ni) of the Mn to Ni being less than 0.11 in particular 0.04 to 0.10, and the balance substantially Fe, and having a wholly tempered martensite structure.

Further, although a martensitic steel having a 450° C., $10^5$-h creep rupture strength of higher than 40 kg/mm$^2$ and a 20° C., V-notch Charpy impact value of higher than 5 kg-m/cm$^2$ is used as a material used for these parts, it has, in its particularly preferable composition, a 450° C., $10^5$-h creep rupture strength of higher than 50 kg/mm$^2$ and a 20° C., V-notch Charpy impact value of higher than 5 kg-m/cm$^2$ after having been heated at 500° C. for $10^3$ hours.

This material may further contain at least one selected from the group consisting of less than 1 wt. % of W, less than 0.5 wt. % of Co, less than 0.5 wt. % of Cu, less than 0.01 wt. % of B, less than 0.5 wt. % of Ti, less than 0.3 wt. % of Al, less than 0.1 wt. % of Zr, less than 0.1 wt. % of Hf, less than 0.01 wt. % of Ca, less than 0.01 wt. % of Mg, less than 0.01 wt. % of Y and less than 0.01 wt. % of rare earth elements.

Among the compressor discs, that for at least the final stage or those for entire stages can be made of the aforementioned heat resistant steel; but since the temperature of gas is low in a zone from the first stage to the middle stage another low alloy steel can be used for the disc in this zone, and the aforementioned heat resistant steel can be used for the discs in a zone from the middle stage to the final stage. For example, for the discs from the first stage on the upstream side of the gas flow to the middle stage it is possible to use a Ni-Cr-Mo-V steel containing 0.15 to 0.30 wt. % of C, less than 0.5 wt. % of Si, less than 0.6 wt. % of Mn, 1 to 2 wt. % of Cr, 2.0 to 4.0 wt. % of Ni, 0.5 to 1 wt. % of Mo, 0.05 to 0.2 wt. % of V and the balance sustantially Fe, and having a room temperature, tensile strength of higher than 80 kg/mm$^2$ and a room temperature, V-notch Charpy impact value of higher than 20 kg-m/cm$^2$, and for the discs from the middle stage to the following stages except for the final stage it is possible to use a Cr-Mo-V steel containing 0.2 to 0.4 wt. % of C, 0.1 to 0.5 wt. % of Si, 0.5 to 1.5 wt. % of Mn, 0.5 to 1.5 wt. % of Cr, less than 0.5 wt. % of Ni, 1.0 to 2.0 wt. % of Mo, 0.1 to 0.3 wt. % of V and the balance substantially Fe, and having a room temperature, tensile strength of higher than 80 kg/mm$^2$, an elongation of higher than 18% and a reduction of area of higher than 50%.

The aforementioned Cr-Mo-V steel can be used for the compressor stub shaft and the turbine stub shaft.

The compressor disc of the present invention is of a flat circular shape and has in its outer portion a plurality of holes into which stacking bolts are inserted, and it is preferable that a ratio (t/D) of the minimum thickness (t) of the compressor disc to the diameter (D) thereof is limited to 0.05 to 0.10

The distance piece of the present invention is of a cylindrical shape and is provided on its both ends with flanges which are respectively connected to the compressor disc and the turbine disc by bolts, and it is preferable that a ratio (t/D) of the minimum thickness (t) to the maximum inner diameter (D) is limited to 0.05 to 0.10.

For the gas turbine of the present invention, it is preferable that a ratio (l/D) of the spacing (l) between the respective turbine discs to the diameter (D) of the gas turbine disc is limited to 0.15 to 0.25.

As an example, in the case of a compressor disc assembly including seventeen stages, the first to twelfth stage discs can be made of the aforementioned Ni-Cr-Mo-V steel, the thirteenth to sixteenth stage discs can be made of the aforementioned Cr-Mo-V steel and the seventeenth stage disc can be made of the aforementioned martensitic steel.

In the compressor disc assembly, the first stage disc has a higher rigidity than the disc in the following stage and the final stage disc has a higher rigidity than the disc in the preceding stage. Also, these discs are formed to be gradually smaller in thickness from the first to final stages, thereby reducing the stress produced by high-speed rotation.

Each of the blades of the compressor is preferably made of a martensitic steel containing 0.05 to 0.2 wt. % of C, less than 0.5 wt. % of Si, less than 1 wt. % of Mn, 10 to 13 wt. % of Cr and the balance Fe, or a martensitic steel further containing in addition to the above composition less than 0.5 wt. % of Mo and less than 0.5 wt. % of Ni.

For a shroud which is formed in the shape of a ring and which makes sliding contact with the outer ends of the turbine blades, it is possible to use at its portion corresponding to the first stage a Ni-based cast alloy containing 0.05 to 0.2 wt. % of C, less than 2 wt. % of Si, less than 2 wt. % of Mn, 17 to 27 wt. % of Cr, less than 5 wt. % of Co, 5 to 15 wt. % of Mo, 10 to 30 wt. % of Fe, less than 5 wt. % of W, less than 0.02 wt. % of B and the balance substantially Ni, and at its portions corresponding to the remaining stages a Fe-based cast alloy containing 0.3 to 0.6 wt. % of C, less than 2 wt. % of Si, less than 2 wt. % of Mn, 20 to 27 wt. % of Cr, 20 to 30 wt. % of Ni, 0.1 to 0.5 wt. % of Nb, 0.1 to 0.5 wt. % of Ti and the balance substantially Fe. These alloys are formed into a ring-shaped structure constituted by a plurality of blocks.

For a diaphragm for fixing a turbine nozzle, the portion corresponding to the first stage turbine nozzle is made of a Cr-Ni steel containing less than 0.05 wt. % of C, less than 1 wt. % of Si, less than 2 wt. % of Mn, 16 to 22 wt. % of Cr, 8 to 15 wt. % of Ni and the balance substantially Fe, and the portions corresponding to the other turbine nozzles are made of a high C-high Ni system cast alloy.

Each of the turbine blades is made of a Ni-based cast alloy containing 0.07 to 0.25 wt. % of C, less than 1 wt. % of Si, less than 1 wt. % of Mn, 12 to 20 wt. % of Cr, 5 to 15 wt. % of Co, 1.0 to 5.0 wt. % of Mo, 1.0 to 5.0 wt. % of W, 0.005 to 0.03 wt. % of B, 2.0 to 7.0 wt. % of Ti, 3.0 to 7.0 wt. % of Al, at least one selected from the group consisting of less than 1.5 wt. % of Nb, 0.01 to 0.5 wt. % of Zr, 0.01 to 0.5 wt. % of Hf and 0.01 to 0.5 wt. % of V, and the balance substantially Ni, and having a structure in which a $\gamma'$ phase and a $\gamma''$ phase are precipitated in an austenite phase matrix. The turbine nozzle is made of a Co-based cast alloy containing 0.20 to 0.60 wt. % of C, less than 2 wt. % of Si, less than 2 wt. % of Mn, 25 to 35 wt. % of Cr, 5 to 15 wt. % of Ni, 3 to 10 wt. % of W, 0.003 to 0.03 wt. % of B and the balance substantially Co, and having a structure in which eutectic carbide and secondary carbide are contained in an austenite phase matrix, or a Co-based cast alloy further containing in addition to the above composition at least one of 0.1 to 0.3 wt. % of Ti, 0.1 to 0.5 wt. % of Nb and 0.1 to 0.3 wt. % of Zr, and having a structure in which eutectic carbide and secondary carbide are contained in an austenite phase matrix. Both of these alloys are subjected to an aging treatment subsequently to a solution heat treatment so as to form the aforementioned precipitates, thereby strengthening the alloys.

Further, in order to prevent the turbine blades from being corroded by high-temperature combustion gases, the diffusion coating of Al, Cr or Al+Cr may be applied onto the turbine blades. It is preferable that the thickness of the coating layer is 30 to 150 μm and that the coating is applied to the blades which are exposed to the gases.

A plurality of combustors are disposed around the turbine, and each of combustors has a dual structure constituted by outer and inner cylinders. The inner cylinder is made of a solution heat-treated Ni-based alloy containing 0.05 to 0.2 wt. % of C, less than 2 wt. % of Si, less than 2 wt. % of Mn, 20 to 25 wt. % of Cr, 0.5 to 5 wt. % of Co, 5 to 15 wt. % of Mo, 10 to 30 wt. % of Fe, less than 5 wt % of W, less than 0.02 wt. % of B and the balance substantially Ni, and having a wholly austenite structure. The inner cylinder is constituted by welding the above Ni-based alloy plate having been subjected to a plastic working to have a thickness of 2 to 5 mm, and provided over whole periphery of the cylindrical body with crescent louver holes through which air is supplied.

The invention will be more clearly understood with reference to the following examples.

EXAMPLE 1

Samples respectively having the compositions (weight percent) shown in Table 1 were melted in an amount of 20 kg, cast into ingots and heated to and forged at 1150° C., and thus the experimental materials were obtained. After these materials had been heated to 1150° C. for 2 hours, they were subjected to air blast cooling and the cooling was stopped when the temperature reached 150° C., and they were subjected to a first tempering by being heated from this temperature to and held at 580° C. for 2 hours followed by air cooling and then to a second tempering by being heated to and held at 605° C. for 5 hours followed by furnace cooling.

Test pieces for a creep rupture test, a tensile test and a V-notch Charpy impact test were extracted from the materials having been subjected to the heat treatments, and were supplied to the experiments. The impact test was effected on an embrittled material which had been obtained by heating the as heat-treated material at 500° C. for 1000 hours. It is deemed from Larson-Miller parameters that this embrittled material has same conditions as the material embrittled by being heated at 450° C. for $10^5$ hours.

TABLE 1

| | Composition (weight %) | | | | | | | | | | |
|---|---|---|---|---|---|---|---|---|---|---|---|
| No. | C | Si | Mn | Cr | Ni | Mo | V | Nb | N | Mn/Ni | Fe |
| 1 | 0.12 | 0.01 | 0.24 | 11.5 | 2.75 | 2.0 | 0.20 | 0.07 | 0.05 | 0.08 | Bal. |
| 2 | 0.12 | 0.25 | 0.71 | 11.5 | 2.83 | 1.8 | 0.32 | — | 0.03 | 0.25 | " |
| 3 | 0.10 | 0.02 | 0.38 | 11.8 | 2.09 | 2.0 | 0.29 | 0.05 | 0.07 | 0.18 | " |
| 4 | 0.10 | 0.09 | 0.71 | 12.0 | 2.41 | 1.9 | 0.29 | 0.04 | 0.06 | 0.30 | " |
| 5 | 0.08 | 0.15 | 0.82 | 11.9 | 1.62 | 2.5 | 0.27 | 0.06 | 0.07 | 0.51 | " |

TABLE 1-continued

| | Composition (weight %) | | | | | | | | | | |
|---|---|---|---|---|---|---|---|---|---|---|---|
| No. | C | Si | Mn | Cr | Ni | Mo | V | Nb | N | Mn/Ni | Fe |
| 6 | 0.09 | 0.09 | 0.84 | 11.8 | 2.10 | 2.3 | 0.35 | 0.05 | 0.07 | 0.40 | " |
| 7 | 0.09 | 0.05 | 0.20 | 11.0 | 1.71 | 1.9 | 0.20 | 0.05 | 0.06 | 0.12 | " |
| 8 | 0.10 | 0.04 | 0.15 | 10.9 | 2.51 | 2.4 | 0.19 | 0.06 | 0.06 | 0.06 | " |

TABLE 2

| | | | | | 450° C. | 25° C. Impact value (kg-m) | |
|---|---|---|---|---|---|---|---|
| No. | Tensile strength ($kg/mm^2$) | 0.2% Proof stress ($kg/mm^2$) | Elongation (%) | Reduction of area (%) | Rupture strength ($kg/mm^2$) | Before embrittlement | After embrittlement |
| 1 | 112.8 | 93.7 | 20.9 | 63.8 | 54.5 | 9.1 | 7.6 |
| 2 | 115.1 | 94.0 | 19.8 | 60.0 | 42.0 | 8.3 | 2.7 |
| 3 | 112.0 | 93.3 | 19.6 | 60.1 | 55.1 | 8.1 | 2.9 |
| 4 | 113.5 | 94.3 | 19.5 | 59.9 | 54.1 | 7.8 | 2.3 |
| 5 | 110.7 | 92.9 | 19.5 | 59.7 | 55.2 | 6.9 | 1.7 |
| 6 | 111.7 | 93.6 | 19.8 | 60.2 | 54.3 | 6.1 | 1.9 |
| 7 | 111.5 | 97.7 | 22.6 | 62.3 | 58.0 | 6.2 | 3.5 |
| 8 | 113.9 | 95.3 | 24.8 | 61.1 | 58.1 | 8.5 | 7.0 |

Referring to Table 1, samples Nos. 1 and 8 are materials according to the present invention, and samples Nos. 2 to 7 are comparative materials and sample No. 2 corresponds to M 152 steel which is currently used as a material for discs.

Table 2 shows the mechanical properties of these samples. It has been confirmed that the materials of the present invention (samples Nos. 1 and 8) satisfactorily meet the 450° C., $10^5$-h creep rupture strength (>50 $kg/mm^2$) required as a material used for high-temperature and high-pressure gas turbines and the 25° C., V-notch Charpy impact value [higher than 4 kg-m (5 $kg-m/cm^2$)] after the embrittlement treatment. In contrast, the material corresponding to M 152 (sample No. 2) which is currently used for gas turbines can not satisfy the mechanical properties which are required as a material used for high-temperature and high-pressure gas turbines since the 450° C., $10^5$-h creep rupture strength is 42 $kg/mm^2$ and the 25° C., V-notch Charpy impact value after embrittlement treatment is 2.7 kg-m. Next, referring to the mechanical properties of the steel samples (samples Nos. 3 to 7) in which the content of Si+Mn is 0.4 to about 1 wt. % and the ratio (Mn/Ni) is higher than 0.12, the respective samples satisfy the value of a creep rupture strength which is required as a material used for high-temperature and high-pressure gas turbines, but they cannot satisfy a V-notch Charpy impact value after the embrittlement since their value is lower than 3.5 kg-m.

Figure 2:
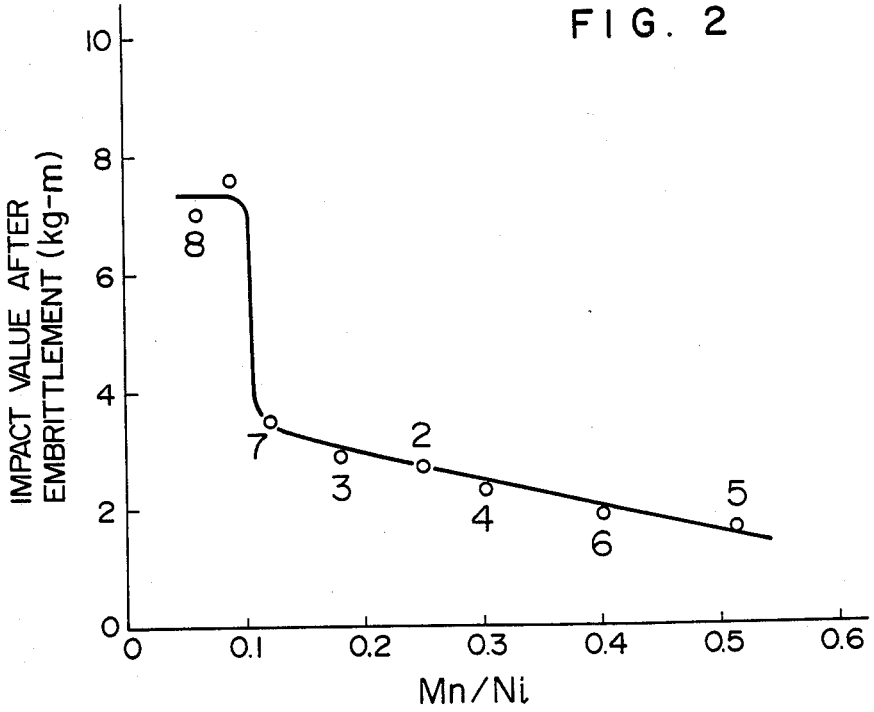
FIG. 2 is a chart showing the relationship between the impact value after embrittlement and the ratio (Mn/Ni)

FIG. 2 is a chart showing the relationship between the impact value after embrittlement and the ratio (Mn/Ni). As shown in FIG. 2, no remarkable improvement appears when the ratio (Mn/Ni) is higher than 0.12, but when the ratio is less than 0.11 the embrittlement is greatly improved to higher than 4 kg-m (5 $kg-m/cm^2$), and further when the ratio is less than 0.10 it is improved to higher than 6 kg-m (7.5 $kg-m/cm^2$). Mn is indispensable as deoxidizer and desulfurizer, so it is necessary to add Mn in an amount of less than 0.6 wt. %.

Figure 3:
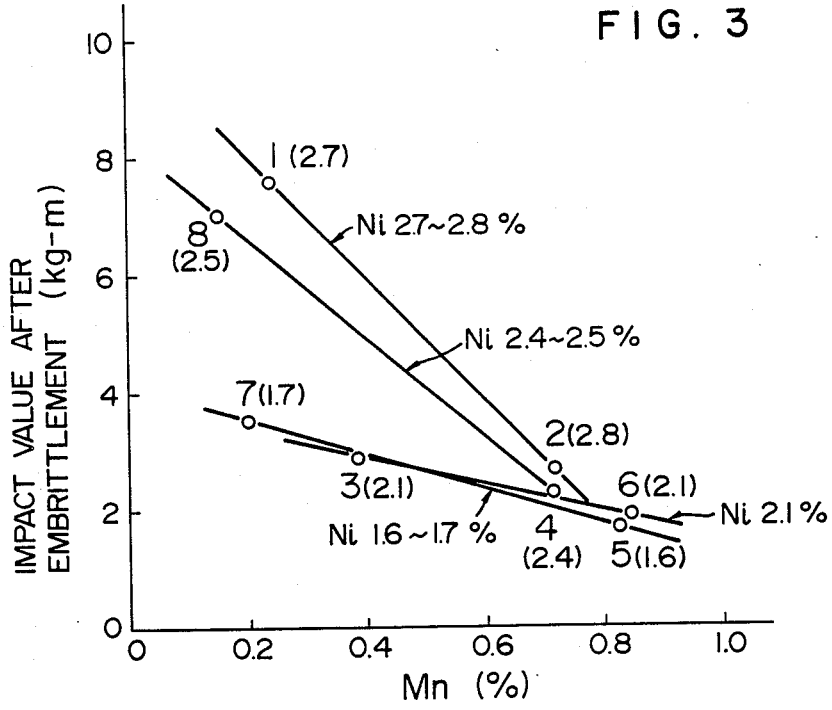
FIG. 3 is a chart similr to FIG. 2, but showing the relationship between the impact value after embrittlement and the Mn content.

FIG. 3 is a chart similar to FIG. 2, but showing the relationship between the impact value after embrittlement and the Mn content. As shown in FIG. 3, when the Ni content is less than 2.1 wt. % a reduction in the Mn content produces no large effect, but when the Ni content exceeds 2.1 wt. % a reduction in Mn content produces remarkable effect. In particular, when the Ni content is higher than 2.4 wt. % a large effect can be obtained.

Moreover, when the Mn content is near 0.7 wt. % no improvement in the impact value is obtained irrespective of the Ni content, but if the Mn content is made lower than 0.6 wt. % and the Ni content is made higher than 2.4 wt. %, the lower the Mn content is the higher impact value can be obtained.

Figure 4:
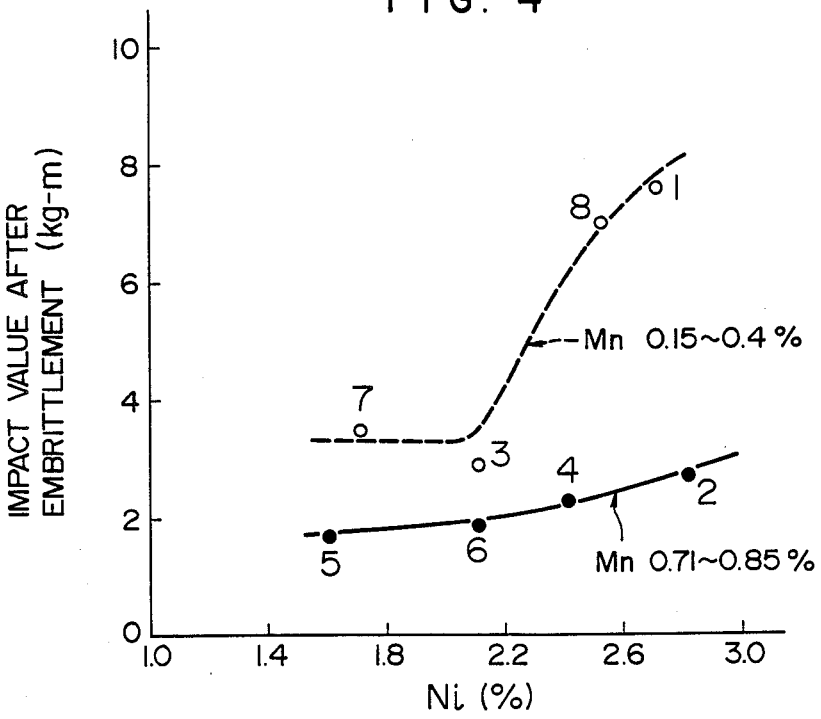
FIG. 4 is a chart similar to FIG. 2, but showing the relationship between the impact value after embrittlement and the Ni content.

FIG. 4 is a chart similar to FIG. 2, but showing the relationship between the impact value after embrittlement and the Ni content. As shown in FIG. 4, when the Mn content is higher than 0.7 wt. % an increase in the Ni content improves the embrittlement to a slight extent, but it is clear that when the Mn content is less than 0.7 wt. % an increase in the Ni content remarkably improves the embrittlement. In particular, it is apparent that, when the Mn content is 0.15 to 0.4 wt. %, if the Ni content is higher than 2.2 wt. % the embrittlement is remarkably improved: namely, if it is higher than 2.4 wt. % impact values higher than 6 kg-m (7.5 $kg-m/cm^2$) can be obtained, and further if it is higher than 2.5 wt. % those higher than 7 kg-m can be obtained.

Figure 5:
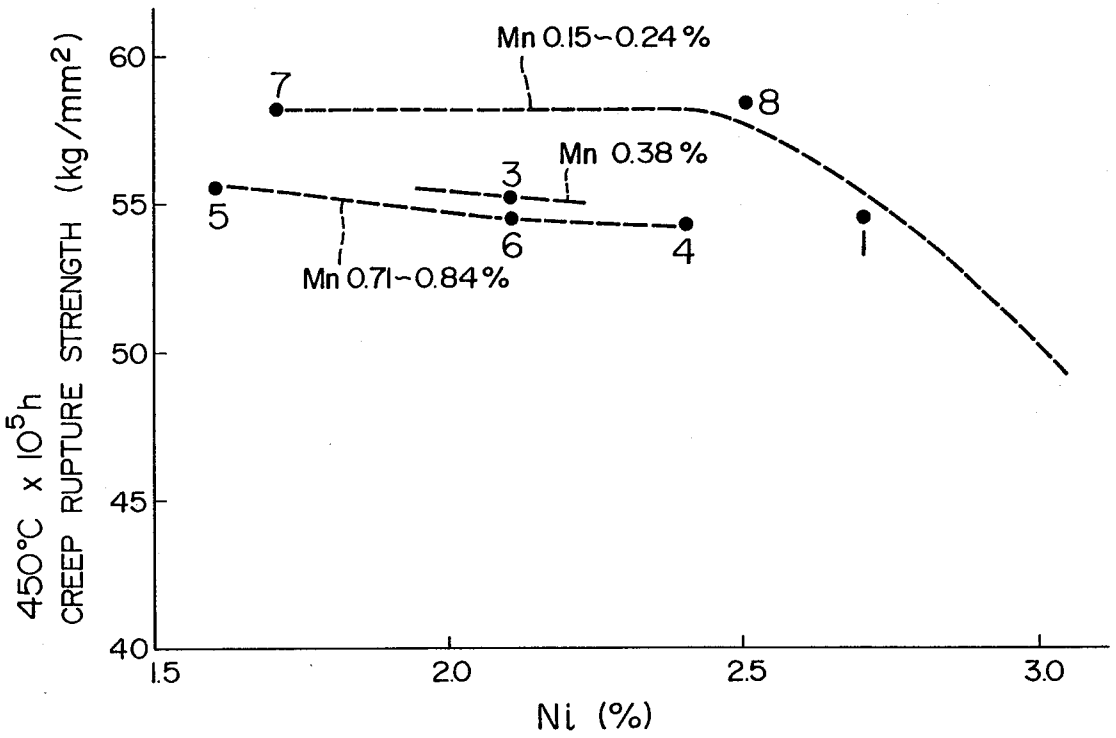
FIG. 5 is a chart showing the relationship between the creep rupture strength and the Ni content.

FIG. 5 is a chart showing the relationship between the 450° C.$\times 10^5$-h rupture strength and the Ni content. As shown in FIG. 5, the Ni content of up to about 2.5 wt. % does not substantially influence the creep rupture strength, but when it exceeds 3.0 wt. % the strength is lowered to less than 50 $kg/mm^2$, so that no desired strength level can be obtained. Further, it is noted that the lower the Mn content is the higher strength can be obtained, and that in the vicinity of 0.15 to 0.25 wt. % the most remarkable strengthening is obtained and thus a high strength is provided.

Figure 6:
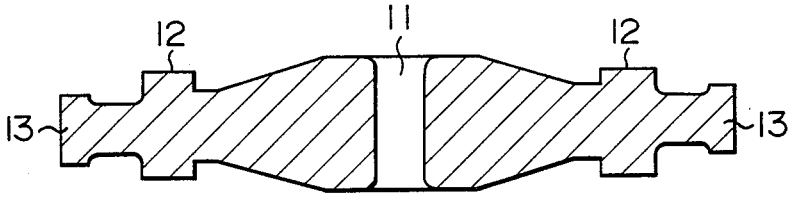
FIG. 6 is a cross-sectional view showing an embodiment of the turbine disc in accordance with the present invention.

FIG. 6 is a cross-sectional view schematically showing a gas turbine disc in accordance with the present invention. Table 3 shows the chemical composition (in percent by weight) of the gas turbine disc.

TABLE 3

| No. | C | Si | Mn | Cr | Ni | Mo | Nb | V | N | Mn/Ni | Fe |
|---|---|---|---|---|---|---|---|---|---|---|---|
| 9 | 0.12 | 0.04 | 0.20 | 11.1 | 2.70 | 2.05 | 0.07 | 0.20 | 0.05 | 0.07 | Bal. |

The melting of the steel material was effected by the carbon vacuum deoxidation method. After forging had been completed, the forged steel was heated at 1050° C. for two hours and hardened in oil of 150° C., and subsequently the hardened steel was subjected to the first tempering by being heated from 150° C. to and held at 520° C. for 5 hours followed by air cooling and then to the second tempering by being heated at 590° C. for 5 hours followed by furnace cooling. After completion of these heat treatments, the steel material was machined into the shape shown in FIG. 6, and the disc thus obtained has an outer diameter of 1000 mm and a thickness of 200 mm. A center hole 11 is 65 mm in diameter. Holes into which the stacking bolts are inserted are formed in portions indicated by 12, and the turbine blades are embedded in portions indicated by 13.

This disc had the superior properties, i.e., 8.0 kg-m (10 kg-m/cm$^2$) in the impact value after the aforementioned embrittlement and 55.2 kg/mm$^2$ in the 450° C.$\times 10^5$-h creep rupture strength.

EXAMPLE 2

FIG. 1 is a cross-sectional view of the rotary section of a gas turbine showing an embodiment of the present invention, in which the above-mentioned discs are used. The rotary section shown comprises a turbine stub shaft 1, turbine blades 2, turbine stacking bolts 3, a turbine spacer 4, a distance piece 5, compressor discs 6, compressor blades 7, compressor stacking bolts 8, a compressor stub shaft 9, turbine discs 10 and a central hole 11. The gas turbine of the present invention has seventeen stages of the compressor discs 6 and two stages of the turbine blades 2. The turbine blades 2 may be three stages, and the steel of the present invention can be applied to both constructions.

The materials shown in Table 4 was made into a large piece of steel equivalent to a real size by the electroslag remelting method, followed by forging and heat treatment. The forging was effected in the temperature range of 850° to 1150° C., and the heat treatment was carried out under the conditions shown in Table 4. Table 4 shows the chemical compositions of the samples in percent by weight. Regarding the microstructures of these materials, the samples Nos. 6 to 9 had wholly tempered matensite structure, and the samples Nos. 10 and 11 had wholly tempered bainite structure. The sample No. 6 was used for the distance piece and the compressor disc at the final stage, the former having a thickness of 60 mm, a width of 500 mm and a length of 1000 mm, and the latter having a diameter of 1000 mm and a thickness of 180 mm. The sample No. 7 was used for the turbine discs each having a diameter of 1000 mm and a thickness of 180 mm. The sample No. 8 was used for the spacer having an outer diameter of 1000 mm, an inner diameter of 400 mm and a thickness of 100 mm. The sample No. 9 was used for both of the turbine and compressor stacking bolts each having a diameter of 40 mm and a length of 500 mm. Incidentally, the sample No. 9 was used also to produce bolts for connecting the distance piece and the compressor discs. The samples Nos. 10 and 11 were respectively forged into the turbine stub shaft and the compressor stub shaft each having a shape of 250 mm in diameter and 300 mm in length. Moreover, the steel sample No. 10 was used for the compressor discs 6 at the thirteenth to sixteenth stages, and the steel sample No. 11 was used for the compressor discs 6 at the first to twelfth stages. All the compressor discs 6 were produced so that the turbine and compressor discs had the same size. The test pieces were extracted, except for the steel No. 9, from the central portion of the samples in a direction perpendicular to the axial (longitudinal) direction of each of the samples. In this example, the test pieces were extracted in the longitudinal direction of the samples.

Table 5 shows the results of tensile strength test at room temperature, V-notch Charpy impact test at 20° C. and creep rupture test for the steel samples shown in Table 4. The 450° C.$\times 10^5$-h creep rupture strength was obtained from Larson-Miller method used in general.

Referring to the steels (12Cr steel) Nos. 6 to 9 according to the present invention, the 450° C., $10^5$-h creep rupture strength is higher than 51 kg/mm$^2$ and the 20° C., V-notch Charpy impact value is higher than 7 kg-m/cm$^2$. It has therefore been confirmed that the steels Nos. 6 to 9 have a sufficient strength as a material used for a high-temperature gas turbine.

Next, the low alloy steels Nos. 10 and 11 for the stub shaft exhibited a low level of the 450° C. creep rupture strength, but had a tensile strength of higher than 86 kg/mm$^2$ and 20° C., V-notch Charpy impact value of higher than 7 kg-m/cm$^2$. It has therefore been confirmed that the steels Nos. 10 and 11 sufficiently meet a strength necessary for a stub shaft (the tensile strength$\geqq$81 kg/mm$^2$ and the 20° C., V-notch Charpy impact value $\geqq$5 kg-m/cm$^2$).

The gas turbine of the present invention constituted by a combination of the aforementioned materials enables a compression ratio of 14.7, an allowable temperature of higher than 350° C., a compression efficiency of higher than 86% and a gas temperature of about 1200° C. in the inlet of the nozzle at the first stage, thereby bringing about a thermal efficiency of higher than 32%. (LHV).

Under these conditions, the temperature of the distance piece and the compressor disc at the final stage becomes 450° C. at the highest. It is preferable that the former has a thickness of 25 to 30 mm and that the latter has a thickness of 40 to 70 mm. The turbine and compressor discs respectively have central through-hole, and a compressive residual stress remains along the central through-hole of the respective turbine discs.

Moreover, the aforesaid heat resistant steel shown in Table 3 was used for the turbine spacer 4, the distance piece 5 and the final-stage compressor disc 6, and the other constituent parts were likewise formed by using the same steel as described above. The resultant constitution enables a compression ratio of 14.7, an allowable temperature of higher than 350° C., a compression efficiency of higher than 86% and a gas temperature of 1200° C. at the inlet of the nozzle at the first stage. In consequence, it is possible to obtain not only a thermal efficiency of higher than 32% but also, as described above, a high level of creep rupture strength and high impact value after the emtrittlement by heating, thereby obtaining a further reliable gas turbine.

TABLE 4

| Example Kind of steel | Composition (%) C | Si | Mn | Cr | Ni | Mo | V | Nb | N | Fe | Heat treatment |
|---|---|---|---|---|---|---|---|---|---|---|---|
| 6 (Distance piece) | 0.10 | 0.04 | 0.70 | 11.56 | 1.98 | 1.98 | 0.20 | 0.08 | 0.06 | Bal. | 1050° C. × 5hOQ<br>550° C. × 15hAC<br>600° C. × 15hAC |
| 7 (Turbine disc) | 0.10 | 0.05 | 0.65 | 11.49 | 1.70 | 2.04 | 0.19 | 0.08 | 0.06 | " | 1050° C. × 8hOQ<br>550° C. × 20hAC<br>600° C. × 20hAC |
| 8 (Spacer) | 0.09 | 0.07 | 0.59 | 11.57 | 2.31 | 2.22 | 0.18 | 0.09 | 0.06 | " | 1050° C. × 3hOQ<br>550° C. × 10hAC<br>600° C. × 10hAC |
| 9 (Stacking bolt) | 0.10 | 0.03 | 0.69 | 11.94 | 1.86 | 2.25 | 0.21 | 0.15 | 0.05 | " | 1050° C. × 1hOQ<br>550° C. × 2hAC<br>600° C. × 2hAC |
| 10 Cr—Mo—V steel | 0.26 | 0.25 | 0.79 | 1.09 | 0.41 | 1.25 | 0.23 | — | — | " | 975° C. × 8hWQ<br>665° C. × 25hAC<br>665° C. × 25hAC |
| 11 Ni—Cr—Mo—V steel | 0.20 | 0.21 | 0.36 | 1.51 | 2.78 | 0.62 | 0.10 | — | — | " | 840° C. × 8hWQ<br>635° C. × 25hAC<br>635° C. × 25hAC |

TABLE 5

| Example Kind of steel | Tensile strength ($kg/mm^2$) | 0.02% Proof stress ($kg/mm^2$) | Elongation (%) | Reduction of area (%) | Impact value $vE_{20}$ ($kg\text{-}m/cm^2$) | $10^5$-h Creep rupture strength ($kg/mm^2$) 450° C. |
|---|---|---|---|---|---|---|
| 6 | 112.0 | 79.3 | 19.8 | 60.1 | 8.7 | 51.1 |
| 7 | 111.7 | 79.5 | 20.1 | 59.3 | 8.3 | 52.3 |
| 8 | 114.3 | 81.2 | 19.5 | 62.5 | 7.2 | 51.3 |
| 9 | 115.7 | 82.6 | 22.3 | 63.4 | 8.7 | 52.7 |
| 10 | 86.4 | — | 26.7 | 68.8 | 7.5 | 35.2 |
| 11 | 86.8 | 77.1 | 26.9 | 69.1 | 18.2 | 23 |

EXAMPLE 3

Figure 7:
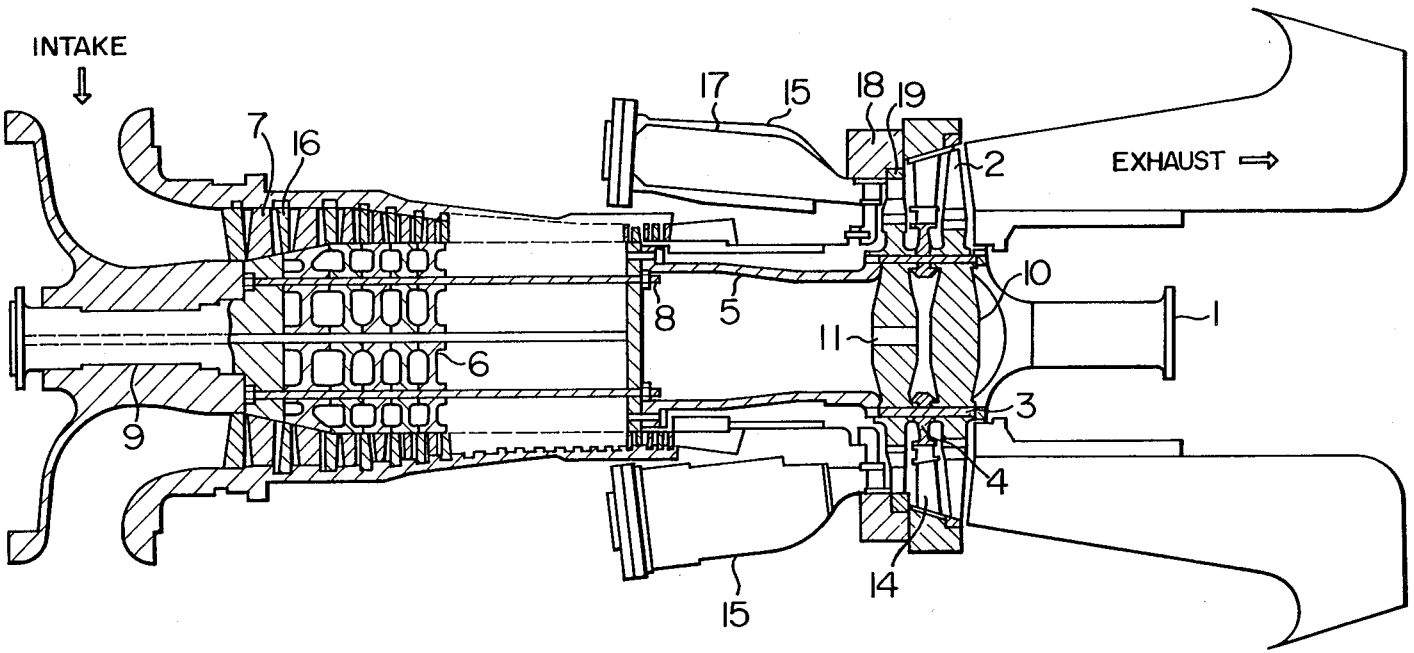
FIG. 7 is a view of another preferred embodiment of the present invention, schematically showing the rotary section of the gas turbine partially in cross-section.

FIG. 7 is an illustration of another preferred embodiment which has gas turbine discs made of the heat resistant steel of the present invention, and in particular shows the rotary section of the gas turbine partially in cross-section. In this embodiment, two stages of turbine disc 10 are provided, and the turbine disc 10 on the upstream side of the gas flow has the central hole 11. All the turbine discs in this embodiment were made of the heat resistant steel shown in Table 3. Moreover, in this embodiment, the heat resistant steel shown in Table 3 was used for the compressor disc 6 at the final stage on the downstream side of the gas flow, the distance piece 5, the turbine spacer 4, the turbine stacking bolts 3 and the compressor stacking bolts 8. The alloys shown in Table 6 were used for other parts, i.e., the turbine blades 2, the turbine nozzle 14, the liners 17 of the combustors 15, the compressor blades 7, the compressor nozzle 16, the diaphragm 18 and the shroud 19. In particular, the turbine nozzle 14 and the turbine blades 2 were made of casting. The compressor in this embodiment has seventeen stages of compressor discs, and is arranged in the same manner as in Example 2. The turbine stub shaft 1 and the compressor stub shaft 9 in this embodiment were also constructed in the same manner as in Example 2.

TABLE 6

| | C | Si | Mn | Cr | Ni | Co | Fe | Mo | B | W | Ti | Others |
|---|---|---|---|---|---|---|---|---|---|---|---|---|
| Turbine blade | 0.15 | 0.11 | 0.12 | 15.00 | Bal. | 9.02 | — | 3.15 | 0.015 | 3.55 | 4.11 | ZR 0.05, Al 5.00 |
| Turbine nozzle | 0.43 | 0.75 | 0.66 | 29.16 | 10.18 | Bal. | — | — | 0.010 | 7.11 | 0.23 | Nb 0.21, Zr 0.15 |
| Combustor liner | 0.07 | 0.83 | 0.75 | 22.13 | Bal. | 1.57 | 18.47 | 9.12 | 0.008 | 0.78 | — | — |
| Compressor blade and nozzle | 0.11 | 0.41 | 0.61 | 12.07 | 0.31 | — | Bal. | — | — | — | — | — |
| Shroud (1) | 0.08 | 0.87 | 0.75 | 22.16 | Bal. | 1.89 | 18.93 | 9.61 | 0.005 | 0.85 | — | — |
| segment (2) | 0.41 | 0.65 | 1.00 | 23.55 | 25.63 | — | Bal. | — | — | — | 0.25 | Nb 0.33 |
| Diaphragm | 0.025 | 0.81 | 1.79 | 19.85 | 11.00 | — | " | — | — | — | — | — |

The turbine blade, turbine nozzle, shroud segment (1) and diaphragm listed in Table 6 were used at the first stage on the upstream side of the gas flow within the gas turbine, and the shroud segment (2) was used at the second stage.

In this embodiment, the final stage compressor disc 6 has a ratio (t/D) of minimum thickness (t) to outer diameter (D) of 0.08, the distance piece 5 has a ratio (t/D) of 0.04. Moreover, a ratio (t/D) of the maximum thickness (t) of the central portion of each of the turbine discs to the diameter (D) thereof is 0.19 in the first stage and 0.205 in the second stage, and a ratio (l/D) of the spacing (l) between the discs to the diameter (D) thereof is 0.21. Spacings are provided between the respective turbine discs. The respective turbine discs has a plurality of holes around the entire periphery thereof at equal intervals for inserting the bolts in order to connect the discs.

The above-described arrangement enables a compression ratio of 14.7, an allowable temperature of higher than 350° C., a compression efficiency of higher than 86% and a gas temperature of 1200° C. at the inlet of the nozzle disposed at the first stage of the turbine, thereby providing a thermal efficiency of higher than 32%. Additionally, the aforementioned heat resistant steel which has a high creep rupture strength and is less embrittled by heating can be used for the turbine discs, the distance piece, the spacers, the compressor disc in the final stage and the stacking bolts. Further, since the alloy having a high high-temperature strength is used for the respective turbine blades, the alloy having a high high-temperature strength and a high high-temperature ductility is used for the turbine nozzle and the alloy having a high high-temperature strength and a high fatigue resistance is used for the liners of the combustors, it is possible to obtain a well-balanced and totally reliable gas turbine.

In accordance with the present invention, it is possible to obtain the heat resistant steel which provides the creep rupture strength and the impact value after embrittlement by heating required by disc for a high-temperature and high-pressure gas turbine (in the class of gas temperature: higher than 1200° C., compression ratio: 15), so that the gas turbine made by using the above steel can bring about excellent effects such as the attainment of an extremely high thermal efficiency.

What is claimed is:

1. A gas turbine comprising:

a turbine stub shaft;

a plurality of turbine discs connected to said turbine stub shaft by turbine stacking bolts with a spacer or spacers interposed therebetween;

turbine blades embedded into each of said turbine discs;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel containing 0.05 to 0.2 wt. % of C, less than 0.5 wt. % of Si, less than 0.6 wt. % of Mn, 8 to 13 wt. % of Cr, 1.5 to 3 wt. % of Mo, 2.2 to 3 wt. % of Ni, 0.05 to 0.3 wt. % of V, 0.02 to 0.2 wt. % in total of either or both of Nb and Ta, 0.02 to 0.1 wt. % of N, a ratio (Mn/Ni) of said Mn to Ni being less than 0.11, and the balance substantially Fe, said martensitic steel having a 450° C., $10^5$-h creep rupture strength of higher than 50 kg/mm$^2$ and a 25° C., V-notch Charpy impact value of hgher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25.

2. A gas turbine according to claim 1, wherein the final stage disc of said compressor discs is more rigid than the preceding stage disc.

3. A gas turbine according to claim 1, wherein at least one of said turbine stacking bolts, said distance piece, said turbine spacer, at least said compressor discs from the final to central stages and said compressor stacking bolts is made of a martensitic steel.

4. A gas turbine according to claim 3, wherein said martensitic steel contains 0.25 to 0.2 wt. % of C, less than 0.5 wt. % of Si, less than 1.5 wt. % of Mn, 8 to 13 wt. % of Cr, 1.5 to 3.5 wt. % of Mo, less than 3 wt. % of Ni, 0.05 to 0.3 wt. % of V, 0.02 to 0.2 wt. % in total of either or both of Nb and Ta, 0.02 to 0.1 wt. % of N and the balance substantially Fe and inevitable impurities.

5. A gas turbine according to claim 4, wherein said martensitic steel has a 450° C., $10^5$-h creep rupture strength of higher than 50 kg/mm$^2$ and a V-notch Charpy impact value of higher than 5 kg-m/cm$^2$.

6. A gas turbine according to any one of claims 1 to 5, wherein said turbine stub shaft is made of a Cr-Mo-V steel containing 0.2 to 0.4 wt. % of C, 0.5 to 1.5 wt. % of Mn, 0.1 to 0.5 wt. % of Si, 0.5 to 1.5 wt. % of Cr, less than 0.5 wt. % of Ni, 1.0 to 2.0 wt. % of Mo, 0.1 to 0.3 wt. % of V and the balance substantially Fe and inevitable impurities.

7. A gas turbine according to any one of claims 1, 2, 3, 4, and 5, wherein said turbine spacer is made of a heat resistant steel containing 0.5 to 0.2 wt. % of C, less than 0.5 wt. % of Si, less than 1 wt. % of Mn, 8 to 13 wt. % of Cr, 1.5 to 3.0 wt. % of Mo, less than 3 wt. % of Ni, 0.05 to 0.3 wt. % of V, 0.02 wt. % of Nb, 0.02 to 0.1 wt. % of N; a ratio (Mn/Ni) of said Mn to Ni being less than 0.11 and the balance substantially Fe and in evitable impurities.

8. A gas turbine according to any one of claims 1, 2, 3, 4 and 5, wherein said turbine stacking bolts are respectively made of a heat resistant steel containing 0.5 to 0.2 wt. % of C, less than 0.5 wt. % of Si, less than 1 wt. % of Mn, 8 to 13 wt. % of Cr, 1.5 to 3.0 wt. % of Mo, less than 3 wt. % of Ni, 0.05 to 0.3 wt. % of V, 0.02 to 0.2 wt. % of Nb, 0.02 to 0.1 wt. % of N; a ratio (Mn/Ni) of said Mn to Ni being less than 0.11 and the balance substantially Fe and inevitable impurities.

9. A gas turbine according to any one of claims 1, 2, 3, 4 and 5, wherein said turbine distance piece is made of a heat resistant steel containing 0.05 to 0.2 wt. % of C, less than 0.5 wt. % of Si, less than 1 wt. % of Mn, 8 to 13 wt. % of Cr, 1.5 to 3.0 wt. % of Mo, less than 3 wt. % of Ni, 0.05 to 0.3 wt. % of V, 0.02 to 0.2 wt. % of Nb, 0.02 to 0.1 wt. % of N; a ratio (Mn/NI) of said Mn to Ni being less than 0.11 and the balance substantially Fe and inevitable impurities.

10. A gas turbine according to any one of claims 1 to 5, wherein said compressor stacking bolt are respectively made of a heat resistant steel containing 0.05 to 0.2 wt. % of C, less than 0.5 wt. % of Si, less than 1 wt. % of Mn, 8 to 13 wt. % of Cr, 1.5 to 3.0 wt. % of Mo, less than 3 wt. % of Ni, 0.05 to 0.3 wt. % of V, 0.02 to 0.2 wt. % of Nb, 0.02 to 0.1 wt. % of N and the balance substantially Fe and inevitable impurities.

11. A gas turbine according to any one of claims 1 to 5, wherein said compressor blades are respectively made of a martensitic steel containing 0.05 to 0.2 wt. % of C, less than 0.5 wt. % of Si, less than 1 wt. % of Mn, 10 to 13 wt. % of Cr and the balance substantially Fe and inevitable impurities.

12. A gas turbine according to any one of claims 1 to 5, wherein said compressor discs disposed from the first to central stages on the upstream side of a gas flow are respectively made of a Ni-Cr-Mo-V steel containing 0.15 to 0.30 wt. % of C, less than 0.5 wt. % of Si, less than 0.6 wt. % of Mn, 1 to 2 wt. % of Cr, 2.0 to 4.0 wt. % of Ni, 0.5 to 1.0 wt. % of Mo, 0.05 to 0.2 wt. % of V and the balance substantially Fe, and wherein said compressor discs disposed from said central stage toward the downstream side except for at least the final stage are respectively made of a Cr-Mo-V steel containing 0.2 to 0.4 wt. % of C, 0.1 to 0.5 wt. % of Si, 0.5 to 1.5 wt. % of Mn, 0.5 to 1.5 wt. % of Cr, less than 0.5 wt. % of Ni, 1.2 to 2.0 wt. % of Mo, 0.1 to 0.3 wt. % of V and the balance substantially Fe. Fe.

13. A gas turbine according to any one of claims 1 to 5, wherein said compressor stub shaft is made of a Cr-Mo-V steel containing 0.15 to 0.3 wt. % of C, less than 0.6 wt. % of Mn, less than 0.5 wt. % of Si, 2.0 to 4.0 wt. % of Ni, 1 to 2 wt. % of Cr, 0.5 to 1 wt. % of Mo, 0.05 to 0.2 wt. % of V and the balance Fe and inevitable impurities.

14. A gas turbine comprising:

a turbine stub shaft;

a plurality of turbine discs connected to said turbine stub shaft by turbine stacking bolts with a spacer or spacers interposed therbetween;

turbine blades embedded into each of said turbine discs;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel containing 0.05 to 0.2 wt. % of C, less than 0.5 wt. % of Si, less than 0.6 wt. % of Mn, 8 to 13 wt. % of Cr, 1.5 to 3 wt. % of Mo, 2.2 to 3 wt. % of Ni, 0.05 to 0.3 wt. % of V, 0.02 to 0.2 wt. % in total of either or both of Nb and Ta, 0.02 to 0.1 wt. % of N, a ratio (Mn/Ni) of said Mn to Ni being less than 0.11, and the balance substantially Fe, said martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25.

15. A gas turbine comprising:

a turbine stub shaft;

a plurality of turbine discs connected to said turbine stub shaft by turbine stacking bolts with a spacer or spacers interposed therebeween;

turbine blades embedded into each of said turbine discs;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel containing 0.05 to 0.2 wt. % of C, less than 0.5 wt. % of Si, less than 0.6 wt. % of Mn, 8 to 13 wt. % of Cr, 1.5 to 3 wt. % of Mo, 2.2 to 3 wt. % of Ni, 0.05 to 0.3 wt. % of V, 0.02 to 0.2 wt. % in total of either or both of Nb and Ta, 0.02 to 0.1 wt. % of N, at least one selected from the group consisting of less than 1 wt. % of W, less than 0.5 wt. % of Co, less than 0.5 wt. % of Cu, less than 0.01 wt. % of B, less than 0.5 wt. % of Ti, less than 0.3 wt. % of Al, less than 0.1 wt. % of Ca, less than 0.01 wt. % of Mg, less than 0.1 wt. % of Y and less than 0.1 wt. % of rare earth elements, a ratio (Mn/Ni) of said Mn to Ni being less than 0.11, and the balance substantially Fe, and having a wholly tempered martensitic structure, said martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25.

16. A gas turbine according to any one of claim 1 to 5, wherein said distance piece and at least said compressor disc used as a final stage disc on a high-temperature side are respectively made of a martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensite, structure.

17. A gas turbine according to claim 16, wherein said distancing piece and at least said compressor disc used as said final stage disc on said high-temperature side are respectively made of a heat resistant steel containing 0.05 to 0.2 wt. % of C, less than 0.5 wt. % of Si, less than 0.6 wt. % of Mn, 8 to 13 wt. % of Cr, 1.5 to 3 wt. % of Mo, 2 to 3 wt. % of Ni, 0.05 to 0.3 wt. % of V, 0.02 to 0.2 wt. % in total of either or both of Nb and Ta, 0.02 to 0.1 wt. % of N, a ratio (Mn/Ni) of said Mn to Ni being less than 0.11, and the balance substantially Fe, and having a wholly tempered martensite structure.

18. A gas turbine according to claim 16, wherein said distance piece and at least said compressor disc used as said final stage disc on said high-temperature side are respectively made of a heat resistant steel containing 0.05 to 0.2 wt. % of C, less than 0.5 wt. % of Si, less than 0.6 wt. % of Mn, 8 to 13 wt. % of Cr, 1.5 to 3 wt. % of Mo, 2 to 3 wt. % of Ni, 0.05 to 0.3 wt. % of V, 0.02 to 0.2 wt. % in total of either or both of Nb, Ta, 0.02 to 0.1 wt. % of N , at least one selected from the group consisting of less than 1 wt. % of W, less than 0.5 wt. % of Co, less than 0.5 wt. % of Cu, less than 0.01 wt. % of B, less than 0.5 wt. % of Ti, less than 0.3 wt. % of Al, less than 0.1 wt. % of Zr, less than 0.1 wt. % of Hf, less than 0.01 wt. % of Ca, less than 0.01 wt. % of Mg, less than 0.01 wt. % of Y and less than 0.01 wt. % of rare earth elements, a ratio (Mn/Ni) of said Mn to Ni being less than 0.11, and the balance substantially Fe, and having a wholly tempered martensite structure.

19. A gas turbine according to any one of claims 1 to 5, wherein said turbine stacking bolts, said spacer, said distance piece, said compressor stacking bolts and said compressor disc used as a final stage disc on a high-temperature side are respectively made of a martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensite structure.

20. A gas turbine, comprising:

a turbine stub shaft a plurality of turbine discs connected to said turbine stub shaft by turbine stacking bolts with a spacer or spacers interposed therebetween;

turbine blades embedded into each of said turbine discs;

a shroud formed in an annular shape for making a sliding contact with the outer circumferential ends of said turbine blades;

a plurality of combustors each having a turbine nozzle for directing the flow of high-temperature gas toward said turbine bldes to cause rotation thereof and a cylindrical body for generating said high-temperature gas;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25, said shroud is, at its portion corresponding to said first stage turbine blade made of a Ni-based alloy containing 0.05 to 0.2 wt. % of C, less than 2 wt. % of Si, less than 2 wt. % of Mn, 17 to 27 wt. % of Cr, less than 5 wt. % of Co, 5 to 15 wt. % of Mo, 10 to 30 wt. % of Fe, less than 5 wt. % of W, less than 0.02 wt. % of B and the balance substantially Ni, and having a wholly austenite structure, and, at its portions corresponding to said turbine blades disposed at the remaining stages, made of a Fe-based cast alloy containing 0.3 to 0.6 wt. % of C, less than 2 wt. % of Si, less than 2 wt. % of Mn, 20 to 27 wt. % of Cr, 20 to 30 wt. % of Ni, 0.1 to 0.5 wt. % of Nb, 0.1 to 0.5 wt. % of Ti and the balance substantially Fe.

21. A gas turbine according to claim 1, comprising:

said turbine stub shaft;

said plurality of turbine discs connected to said turbine stub shaft by said turbine stacking bolts with said spacer or spacers interposed therebetween;

said turbine blades embedded into each of said turbine discs;

said plurality of combustors each having said turbine nozzle for directing the flow of high-temperature gas toward said turbine blades to cause rotation thereof, having a diaphragm for fixing said turbine nozzle and having said cylindrical body for generating said high-temperature gas;

said distance piece connected to said turbine discs by said turbine stacking bolts;

said plurality of compressor discs connected to said distance piece by compressor stacking bolts;

said compressor blades embedded into each of said compressor discs; and said compressor stub shaft integral with the first stage disc of said compressor discs;

characterized in that said diaphragm is, at its first stage turbine blade portion for directing the flow of high-temperature gas toward said first stage turbine blades, made of a Cr—Ni steel containing less than 0.05 wt. % of C, less than 1 wt. % of Si, less than 2 wt. % of Mn, 16 to 22 wt. % of Cr, 8 to 15 wt. % of Ni and the balance substantially Fe.

22. A gas turbine according to claim 6, comprising:

said turbine stub shaft;

said plurality of turbine discs connected to said turbine stub shaft by said turbine stacking bolts with said spacer or spacers interposed therebetween;

said turbine blades embedded into each of said turbine discs;

said plurality of combustors each having said turbine nozzle for directing the flow of high temperature gas toward said turbine blades to cause rotation thereof and said cylindrical body for generating said high-temperature gas;

said distance piece connected to said turbine discs by said turbine stacking bolts;

said plurality of compressor discs connected to said distance piece by said compressor stacking bolts;

said compressor blades embedded into each of said compressor discs;

a compressor nozzle for directing air toward said compressor blades; and said compressor stub shaft integral with the first stage disc of said compressor discs;

characterized in that said compressor nozzle is made of a martensitic steel containing 0.05 to 0.2 wt. % of C, less than 0.5 wt. % of Si, less than 1 wt. % of Mn, 10 to 30 wt. % of Cr, or further less than 0.5 wt. % of Ni and less than 0.5 wt. % of Mo, and the balance substantially Fe;

that said compressor discs which are disposed in a low-temperature range including said first stage are respectively made of a Ni—Cr—Mo—V steel containing 0.15 to 0.3 wt. % of C, less than 0.5 wt. % of Si, less than 0.6 wt. % of Mn, 1 to 2 wt. % of Cr, 2 to 4 wt. % of Ni, 0.5 to 1 wt. % of Mo, 0.05 to 0.2 wt. % of V and the balance substantially Fe; and that said compressor discs which are disposed at the remaining stages of high-temperature side are respectively made of a Cr—Mo—V steel containing 0.2 to 0.4 wt. % of C, 0.1 to 0.5 wt. % of Si, 0.5 to 1.5 wt. % of Mn, 0.5 to 1.5 wt. % of Cr, less than 0.5 wt. % of Ni, 1 to 2 wt. % of Mo, 0.1 to 0.3 wt. % of V and the balance substantially Fe.

23. A gas turbine comprising:

a turbine stub shaft a plurality of turbine discs connected to said turbine stub shaft by turbine stacking bolts with a spacer or spacers interposed therebetween;

turbine blades embedded into each of said turbine discs;

a plurality of combustors each having a turbine nozzle for directing the flow of high-temperature gas toward said turbine blades to cause rotation thereof and a cylindrical body for generating said high-temperature gas;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25 and said turbine blades are respectively made of a Ni-based cast alloy containing 0.07 to 0.25 wt. % of C, less than 1 wt. % of Si, less than 1 wt. % of Mn, 12 to 20 wt. % of Cr, 5 to 15 wt. % of Co, 1 to 5 wt. % of Mo, 1 to 5 wt. % of W, 0.005 to 0.3 wt. % of B, 2 to 7 wt. % of Ti, 3 to 7 wt. % of Al, at least one selected from the group consisting of less than 1.5 wt. % of Nb, 0.01 to 0.5 wt. % of Zr, 0.01 to 0.5 wt. % of Hf and 0.01 to 0.5 wt. % of V, and the balance substantially Ni, and having Γ' and Γ'' phases;

that said turbine nozzle is made of either a Co-based cast alloy containing 0.20 to 0.6 wt. % of C, less than 2 wt. % of Si, less than 2 wt. % of Mn, 25 to 35 wt. & of Cr, 5 to 15 wt. % of Ni, 3 to 10 wt. % of W, 0.003 wt. % of B and the balance substantially Co, and having an austenite matrix containing therein eutectic carbide and secondary carbide, or a Co-based cast alloy further containing, in addition to the above composition, at least one selected from the group consisting of 0.1 to 0.3 wt. % of Ti, 0.1 to 0.5 wt. % of Nb and 0.1 to 0.3 wt. % of Zr, and having an austenite matrix containing therein eutectic carbide and secondary carbide; and that said combustors are respectively made of a Ni-based alloy containing 0.05 to 0.2 wt. % of C, less than 2 wt. % of Si, less than 2 wt. % of Mn, 20 to 25 wt. % of Cr, 0.5 to 5 wt. % of Co, 5 to 15 wt. % of Mo, 10 to 30 wt. % of Fe, less than 5 wt. % of W, less than 0.02 wt. % of B and the balance substantially Ni, and having a wholly austenite structure.

24. A gas turbine comprising:

a turbine stub shaft;

a plurality of turbine discs connected to said turbine stuf shaft by turbine stacking bolts with a spacer or spacers interposed therebetween;

turbine blades embedded into each of said turbine discs;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel containing 0.05 to 0.2 wt. % of C, less than 0.5 wt. % of Si, less than 0.6 wt. % of Mn, 8 to 13 wt. % of Cr, 1.5 to 3 wt. % of Mo, 2.2 to 3 wt. % of Ni, 0.05 to 0.3 wt. % of V, 0.02 to 0.2 wt. % in total of either or both of Nb and Ta, 0.02 to 0.1 wt. % of N, a ratio (Mn/Ni) of said Mn to Ni being less than 0.11, and the balance substantially Fe, said martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure.

25. A gas turbine comprising:

a turbine stub shaft;

a plurality of turbine discs connected to said turbine stub shaft by turbine stacking bolts with a spacer or spacers interposed therebetween;

turbine blades embedded into each of said turbine discs;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel containing 0.05 to 0.2 wt. % of C, less than 0.5 wt. % of Si, less than 0.6 wt. % of Mn, 8 to 13 wt. % of Cr, 1.5 to 3 wt. % of Mo, 2.2 to 3 wt. % of Ni, 0.05 to 0.3 wt. % of V, 0.02 to 0.2 wt. % in total of either or both of Nb and Ta, 0.02 to 0.1 wt. % of N, a ratio (Mn/Ni) of said Mn to Ni being less than 0.11, and the balance substantially Fe said martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25.

26. A gas turbine comprising:

a turbine stud shaft;

a plurality of turbine discs connected to said turbine stub shaft by turbine stacking bolts with a spacer or spacers interposed therebetween;

turbine blades embedded into each of said turbine discs;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel containing 0.05 to 0.2 wt. % of C, less than 0.5 wt. % of Si, less than 0.6 wt. % of Mn, 8 to 13 wt. % of Cr, 1.5 to 3 wt. % of Mo, 2.2 to 3 wt. % of Ni, 0.05 to 0.3 wt. % of V, 0.02 to 0.2 wt. % in total of either or both of Nb and Ta, 0.02 to 0.1 wt. % of N, at least one selected from the group consisting of less than 1 wt. % of W, less than 0.5 wt. % of Co, less than 0.5 wt. % of Cu, less than 0.01 wt. % of B, less than 0.5 wt. % of Ti, less than 0.3 wt. % of Al, less than 0.1 wt. % of Ca, less than 0.01 wt. % of Mg, less than 0.1 wt. % of Y and less than 0.1 wt. % of rare earth elements, a ratio (Mn/Ni) of said Mn to Ni being less than 0.11, and the balance substantially Fe, and having a wholly tempered martensitic structure, said martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25.

27. A gas turbine comprising:

a turbine stub shaft a plurality of turbine discs connected to said turbine stub shaft by turbine stacking bolts with a spacer or spacers interposed therebetween;

turbine blades embedded into each of said turbine discs;

a shroud formed in an annular shape for making a sliding contact with the outer circumferential ends of said turbine blades;

a plurality of combustors each having a turbine nozzle for directing the flow of high-temperature gas toward said turbine blades to cause rotation thereof and a cylindrical body for generating said high-temperature gas;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25, said shroud is, at its portion corresponding to said first stage turbine blade made of a Ni-based alloy containing 0.05 to 0.2 wt. % of C, less than 2 wt. % of Si, less than 2 wt. % of Mn, 17 to 27 wt. % of Cr, less than 5 wt. % of Co, 5 to 15 wt. % of Mo, 10 to 30 wt. % of Fe, less than 5 wt. % of W, less than 0.02 wt. % of B and the balance substantially Ni, and having a wholly austenite structure, and, at its portions corresponding to said turbine blades disposed at the remaining stages, made of a Fe-based cast alloy containing 0.3 to 0.6 wt. % of C, less than 2 wt. % of Si, less than 2 wt. % of Mn, 20 to 27 wt. % of Cr, 20 to 30 wt. % of Ni, 0.1 to 0.5 wt. % of Nb, 0.1 to 0.5 wt. % of Ti and the balance substantially Fe.

28. A gas turbine comprising:

a turbine stub shaft a plurality of turbine discs connected to said turbine stub shaft by turbine stacking bolts with a spacer or spacers interposed therebetween;

turbine blades embedded into each of said turbine discs;

a plurality of combustors each having a turbine nozzle for directing the flow of high-temperature gas toward said turbine blades to cause rotation thereof and a cylindrical body for generating said high-temperature gas;

a distance piece connected to said turbine discs by said turbine stacking bolts;

a plurality of compressor discs connected to said distance piece by compressor stacking bolts;

compressor blades embedded into each of said compressor discs; and a compressor stub shaft integral with the first stage disc of said compressor discs;

characterized in that at least said turbine discs are respectively made of martensitic steel having a 450° C., $10^5$-h creep rupture strength of higher than 50 kg/mm$^2$ and a 25° C., V-notch Charpy impact value of higher than 5 kg-m/cm$^2$ after having been heated at 500° C. for $10^3$ hours, and having a wholly tempered martensitic structure, and that a ratio (l/D) of the gap (l) between said respective turbine discs to the outer diameter (D) of the same is 0.15 to 0.25 and said turbine blades are respectively made of a Ni-based cast alloy containing 0.07 to 0.25 wt. % of C, less than 1 wt. % of Si, less than 1 wt. % of Mn, 12 to 20 wt. % of Cr, 5 to 15 wt. % of Co, 1 to 5 wt. % of Mo, 1 to 5 wt. % of W, 0.005 to 0.3 wt. % of B, 2 to 7 wt. % of Ti, 3 to 7 wt. % of Al, at least one selected from the group consisting of less than 1.5 wt. % of Nb, 0.01 to 0.5 wt. % of Zr, 0.01 to 0.5 wt. % of Hf and 0.01 to 0.5 wt. % of V, and the balance substantially Ni, and having $\gamma'$ and $\gamma''$ phases;

that said turbine nozzle is made of either a Co-based cast alloy containing 0.20 to 0.6 wt. % of C, less than 2 wt. % of Si, less than 2 wt. % of Mn, 25 to 35 wt. & of Cr, 5 to 15 wt. % of Ni, 3 to 10 wt. % of W, 0.003 wt. % of B and the balance substantially Co, and having an austenite matrix containing therein eutectic carbide and secondary carbide, or a Co-based cast alloy further containing, in addition to the above composition, at least one selected from the group consisting of 0.1 to 0.3 wt. % of Ti, 0.1 to 0.5 wt. % of Nb and 0.1 to 0.3 wt. % of Zr, and having an austenite matrix containing therein eutectic carbide and secondary carbide; and that said combustors are respectively made of a Ni-based alloy containing 0.05 to 0.2 wt. % of C, less than 2 wt. % of Si, less than 2 wt. % of Mn, 20 to 25 wt. % of Cr, 0.5 to 5 wt. % of Co, 5 to 15 wt. % of Mo, 10 to 30 wt. % of Fe, less than 5 wt. % of W, less than 0.02 wt. % of B and the balance substantially Ni, and having a wholly austenite structure.

* * * * *